US010107048B2

(12) United States Patent
Chen

(10) Patent No.: US 10,107,048 B2
(45) Date of Patent: Oct. 23, 2018

(54) WEATHERVANING RISER JOINT

(71) Applicant: Ensco International Incorporated, Wilmington, DE (US)

(72) Inventor: Shiyu Chen, Katy, TX (US)

(73) Assignee: Ensco International Incorporated, Wilmington, DE (US)

( * ) Notice: Subject to any disclaimer, the term of this patent is extended or adjusted under 35 U.S.C. 154(b) by 0 days.

(21) Appl. No.: 15/716,070

(22) Filed: Sep. 26, 2017

(65) Prior Publication Data

US 2018/0087329 A1 Mar. 29, 2018

Related U.S. Application Data

(60) Provisional application No. 62/401,639, filed on Sep. 29, 2016.

(51) Int. Cl.
*E21B 17/01* (2006.01)

(52) U.S. Cl.
CPC ..... *E21B 17/012* (2013.01)

(58) Field of Classification Search
CPC ..... E21B 17/01; E21B 17/012; E21B 17/015
See application file for complete search history.

(56) References Cited

U.S. PATENT DOCUMENTS 4,078,605 A * 3/1978 Jones ..... E21B 17/01 166/359
4,398,487 A * 8/1983 Ortloff ..... B63B 1/32 114/243
4,474,129 A * 10/1984 Watkins ..... B63B 21/663 114/243
5,722,340 A * 3/1998 Sweetman ..... F15D 1/10 114/243
6,712,559 B2 * 3/2004 Lenormand ..... E21B 17/012 166/350
6,848,863 B2 * 2/2005 Karayaka ..... B63B 43/00 114/243
6,948,884 B2 * 9/2005 Xu ..... E21B 17/01 405/211
8,443,896 B2 * 5/2013 Howard ..... E21B 17/012 166/345
9,022,075 B2 * 5/2015 Allen ..... F16L 1/15 114/243
9,322,221 B2 * 4/2016 Howard ..... E21B 17/012
(Continued)

FOREIGN PATENT DOCUMENTS

WO WO-9905389 A1 * 2/1999 ..... B63B 21/502

OTHER PUBLICATIONS

PCT Application No. PCT/US2017/053698, International Search Report and Written Opinion, dated Dec. 12, 2017, 13 pgs.

*Primary Examiner* — Matthew R Buck
(74) *Attorney, Agent, or Firm* — Fletcher Yoder, P.C.

(57) ABSTRACT

Techniques and systems to reduce deflection of a riser extending from an offshore platform. A device may include a main tube disposed along a length of the device. The device may also include a support member that may be coupled to the main tube, wherein the support member may surround the main tube. The device may include a buoyancy assembly that may at least partially surround the main tube, wherein the buoyancy assembly may have an elongated non-circular and non-cylindrical shape. The buoyancy assembly may also include buoyancy foam.

19 Claims, 5 Drawing Sheets

(56) References Cited

U.S. PATENT DOCUMENTS

| | | | | |
|---|---|---|---|---|
| 9,845,644 | B2 * | 12/2017 | Howard | E21B 17/012 |
| 2004/0266290 | A1 * | 12/2004 | Gibson | E21B 17/012<br>441/133 |
| 2005/0241832 | A1 * | 11/2005 | Jones | E21B 17/012<br>166/367 |
| 2007/0104542 | A1 * | 5/2007 | Somerville | B63B 21/663<br>405/224.1 |
| 2008/0025800 | A1 * | 1/2008 | Watkins | B63B 21/502<br>405/216 |
| 2010/0061809 | A1 * | 3/2010 | Allen | B63B 39/005<br>405/216 |
| 2010/0129159 | A1 | 5/2010 | Brown | |
| 2014/0241793 | A1 | 8/2014 | West et al. | |
| 2014/0326461 | A1 | 11/2014 | Tan et al. | |

* cited by examiner

WEATHERVANING RISER JOINT

CROSS REFERENCE TO RELATED APPLICATIONS

This application is a Non-Provisional Application claiming priority to U.S. Provisional Patent Application No. 62/401,639, entitled "Weathervaning Riser Joint", filed Sep. 29, 2016, which is herein incorporated by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. To drill for oil and gas offshore, it is desirable to have stable offshore platforms and/or floating vessels from which to drill and recover the energy resources. Techniques to stabilize the offshore platforms and floating vessels include, for example, the use of mooring systems and/or dynamic positioning systems. However, these systems may not always adequately stabilize components descending from the offshore platforms and floating vessels to the seafloor wellhead.

For example, a riser string or riser (e.g., a pipe or series of pipes, such as riser joints, that connects the offshore platforms or floating vessels to the floor of the sea) may be used to transport drill pipe, casing, drilling mud, production materials or hydrocarbons between the offshore platform or floating vessel and a wellhead. The riser is suspended between the offshore platform or floating vessel and the wellhead, and may experience forces, such as underwater currents, that cause deflection (e.g., bending or movement) or vortex induced vibrations (VIV) in the riser. Acceptable deflection can be measured by the deflection along the riser, and also at, for example, select points along the riser. These points may be located, for example, at the offshore platform or floating vessel and at the wellhead. If the deflection resulting from underwater current is too great, drilling must cease and the drilling location or reservoir may not be accessible due to such technological constraints. If the vibrations due to the currents are too great, the riser and/or the wellhead may experience accelerated fatigue damage.

DETAILED DESCRIPTION

Figure 1:
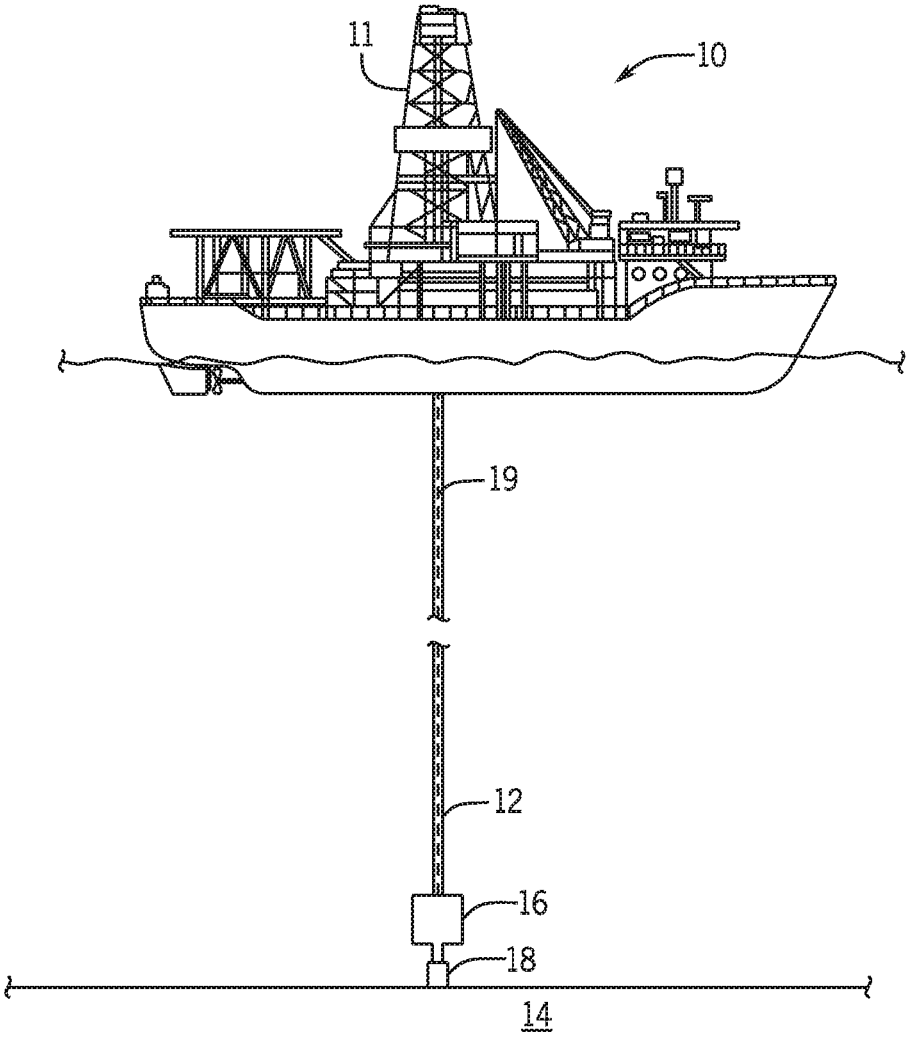
FIG. 1 illustrates an example of an offshore platform with a riser.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Systems and techniques for stabilizing a riser (e.g., a riser string made up of a series of riser joints coupled to one another) extending from offshore platform, such as a drillship, a semi-submersible platform, a floating production system, or the like, are set forth below. During offshore drilling operations, high current or high loop current is sometimes occurred, and it may cause large drag force and/or deflection on the riser (e.g., especially for buoyancy joints of the riser, which may have diameters up to 55" or more) and vortex induced vibrations (VIV), which can cause riser failure and, thus, require cessation of drilling and/or production operations. In some embodiments, fairings and/or helical strakes may be used along the riser. However, these helical strakes tend to aid in VIV suppression but not necessarily in reducing the drag force. Additionally, installation and removal of fairings and/or /helical strakes may be time consuming, thus slowing operations of the offshore platform.

Accordingly, additional embodiments herein may include specialty riser joints with weathervaning buoyancy (e.g., drilling and/or production specialty riser joints that may form a portion or all of the riser) that are designed to operate to greatly reduce the drag coefficient and drag force on the riser. By altering the shape of the specialty riser joints' buoyancy from a cylindrical or circular shape to that of an elongated shape (e.g., an elliptical or airfoil shape), the drag coefficient and drag force of the specialty riser joints can be greatly reduced. Also, the VIV may be greatly reduced and/or eliminated.

In some embodiments, the specialty riser joints may be fixed with respect to an axial, radial, and circumferential directions. In other embodiments, the elongated shape of the specialty riser joints may allow for the specialty riser joints to be fixed with respect to an axial and a radial direction, while capable of rotation in a circumferential direction. This circumferential motion may be in response to, for example, forces imparted to the specialty riser joints by currents.

Through rotation of the specialty riser joints, the drag coefficient and drag force of specialty riser joints resulting from the shape thereof may be preserved even as currents change in the field.

With the foregoing in mind, FIG. 1 illustrates an offshore platform includes an offshore vessel 10. Although the presently illustrated embodiment of an offshore vessel 10 is a drillship (e.g., a ship equipped with a drill rig and engaged in offshore oil and gas exploration and/or well maintenance or completion work including, but not limited to, casing and tubing installation, subsea tree installations, and well capping), other offshore platforms such as a semi-submersible platform, a floating production system, or the like may be substituted for the drillship. Indeed, while the techniques and systems described below are described in conjunction with a drillship, the techniques and systems are intended to cover at least the additional offshore platforms described above.

As illustrated in FIG. 1, the offshore vessel 10, with a derrick 11 thereon, includes a riser 12 extending therefrom. The riser 12 may include a pipe or a series of pipes (e.g., riser joints) that connect the offshore vessel 10 to the seafloor 14 via, for example, blow out preventer (BOP) 16 that is coupled to a wellhead 18 on the seafloor 14. These riser joints may include one or more of, for example, drilling riser joints, slick joints, buoyancy joints, pup joints, telescopic joints, production joints, or other types of riser joints as part of the riser 12. In some embodiments, the riser 12 may transport produced hydrocarbons and/or production materials between the offshore vessel 10 and the wellhead 18, while the BOP 16 may include at least one valve with a sealing element to control wellbore fluid flows. In some embodiments, the riser 12 may pass through an opening (e.g., a moonpool) in the offshore vessel 10 and may be coupled to drilling equipment of the offshore vessel 10. As illustrated in FIG. 1, it may be desirable to have the riser 12 positioned in a vertical orientation between the wellhead 18 and the offshore vessel 10, for example, to allow a drill string made up of drill pipes 19 to pass from the offshore vessel 10 through the BOP 16 and the wellhead 18 and into a wellbore below the wellhead 18. However, external factors (e.g., environmental factors such as currents) may disturb the vertical orientation of the riser 12.

Figure 2:
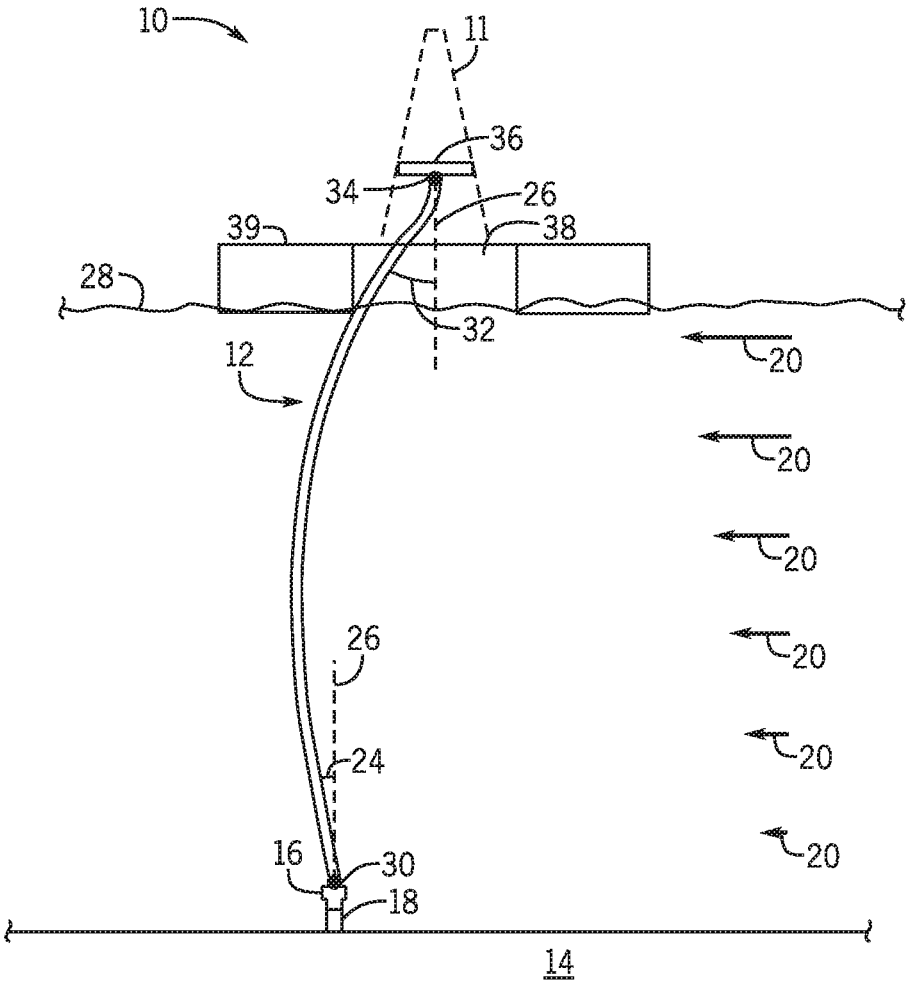
FIG. 2 illustrates an example of the offshore platform of FIG. 1 with the riser experiencing deflection.

As illustrated in FIG. 2, the riser 12 may experience deflection, for example, from currents 20. These currents 20 may apply forces on the riser 12, which causes deflection (e.g., motion, bending, or the like) in riser 12. Thus, when the offshore vessel 10 works under the existence of strong currents 20, the riser 12 will have significant horizontal deflection due to the drag loads applied along the riser 12. As a result, the angle 24 between the vertical axis 26 (e.g., an axis that is perpendicular to the seafloor 14 and extends vertically to the surface of the sea 28) and the riser bottom flex joint 30 may exceed tolerance levels for the performance of, for example, drilling operations.

This angle 24 may be modified through the dynamic positioning of the offshore vessel 10. That is, through the movement of the offshore vessel 10 in response to the currents 20, the static angle 24 of the bottom flex joint 30 may be reduced and/or eliminated to meet any operational requirements associated with, for example, the blow out preventer 16, the wellhead 18, and/or the riser 12. However, adjustment of the position of the offshore vessel 10 to reduce and/or eliminate the static angle 24 of the bottom flex joint 30 may also increase the the angle 32 of top flex joint 34 beneath drill floor 36 with respect to the vertical axis 26. This may cause the portion of the riser 12 beneath the drill floor as it passes through the moonpool 38 to interfere with the hull 39 of the offshore vessel 10. This interference between the riser 12 and the hull 39 is to be avoided.

Thus, force applied to the riser 12 from the currents 20 (or other environmental forces) may cause the riser 12 to stress the BOP 16 or cause key seating, as the angle 24 that the riser 12 contacts the BOP 16 may be affected via the deflection of the riser 12. Likewise, the currents 20 and/or efforts to mitigate the force of the currents 20 (e.g., dynamic positioning of the offshore vessel) may cause the riser 12 to contact the edge of the moonpool 38 of the offshore vessel 10. To reduce the deflection of the riser 12, and to reduce the chances of occurrence of the aforementioned problems caused by riser 12 deflection, additional systems and techniques may be employed.

Figure 3:
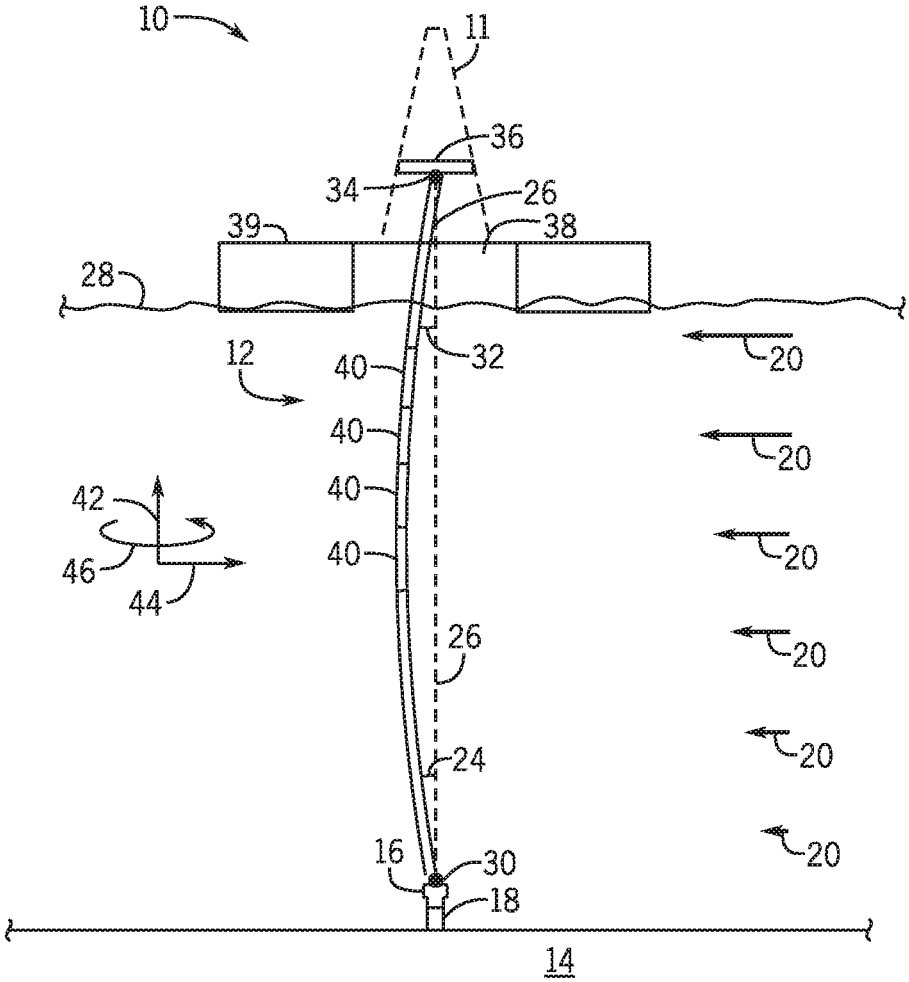
FIG. 3 illustrates a first embodiment of a system to mitigate the deflection of the riser of FIG. 2.

FIG. 3 illustrates a system to mitigate the deflection of the riser 12. In some embodiments, reduction of the angle 32 and, indeed, deflection of the riser 12 as a whole may be accomplished through the use of one or more elongated riser joints 40 of the riser 12. These specialized riser joints (e.g., elongated riser joints 40) may be disposed along an entire length of the riser 12 or, for example, along one or more predetermined portions of the riser 12 that cumulatively result in a length of elongated riser joints 40 less than an entire length of the riser 12. In some embodiments, each elongated riser joint 40 may have a fixed geometry (e.g., a fixed shape and elongation). In other embodiments, at least one riser joint may be tapered such that the length of the elongation of the elongated riser joint 40 tapers along an axial distance of the elongated riser joint 40. Likewise, a series of elongated riser joints 40 may be utilized whereby each elongated riser joint 40 has a fixed elongation length, but the elongation lengths between elongated riser joints 40 differs (e.g., to allow for net tapering of the elongation of the elongated riser joints 40 when taken as a group).

The elongated riser joints 40 may have an elongated shape such as an elliptical shape (which, may in some embodiments, include an offset of its center along a rotational axis, for example, axial direction 42), an airfoil shape (e.g., a fin, a blade, or a vane), a shape with a leading edge that tapers to a trailing edge (e.g., a teardrop), or the like. The elongated riser joints 40 have also have a non-circular shape as well as a non-cylindrical shape as the elongated shape. For example, the elongated riser joints may have one or more streamline bodies as the elongated non-circular and non-cylindrical shape. Indeed, while circular shaped riser joints may have a drag coefficient to approximately 1.2 for laminar flow, the elongated riser joints 40 may have a reduced drag coefficient of approximately 0.2~0.6 along with reduced and/or eliminated VIV with respect to circular riser joints. An elongated riser joint 40 may be, for example, a buoyancy joint and the elongated riser joint 40 may have an elliptical cross section may include a length to width ratio of approximately 2:1, which can reduce drag and drag coefficient to approximately 0.435 while also greatly reducing and/or eliminating VIV. As previously noted, the elliptical cross section of the elongated riser joints 40 may include a offset of their center to the rotation axis for example, axial direction 42, so as to create weathervane movement, rotation, or the like. In some embodiments, the amount of offset from the center of the elongated riser joints 40 may be chosen dependent on, for example, desired amount of rotation, the environment in which the elongated riser joints 40 will be utilized, or the like. As illustrated in FIG. 3, and as will be discussed in greater detail below, the riser 12 with at least one elongated riser joint 40 may be disposed between the offshore platform 10 and the seafloor 14, whereby the riser 12 includes at least one elongated riser joint 40 is disposed in an axial direction 42 (e.g., along a longitudinal axis). Also illustrated for reference is a radial direction 44, which may be used to describe, for example, a width of the elongated riser joint 40. Additionally, as will be discussed in greater detail below, at least one portion of the elongated riser joint 40 may rotate in a circumferential direction 46, for example, in response to currents 20, whereby the elongated riser joint 40 is elongated (e.g., may have an elongated shape) in the radial direction 44 (at a width of the elongated riser joint 40).

Figure 4A:
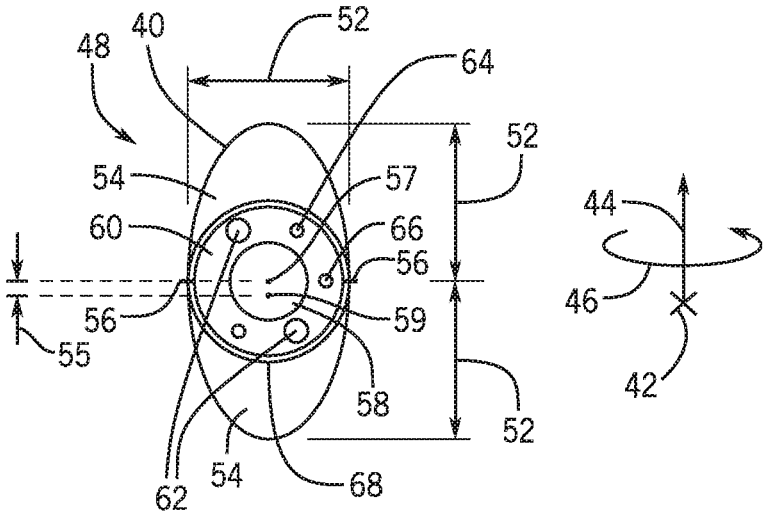
FIG. 4A illustrates a top view of a riser restraint device of FIG. 3.
Figure 4B:
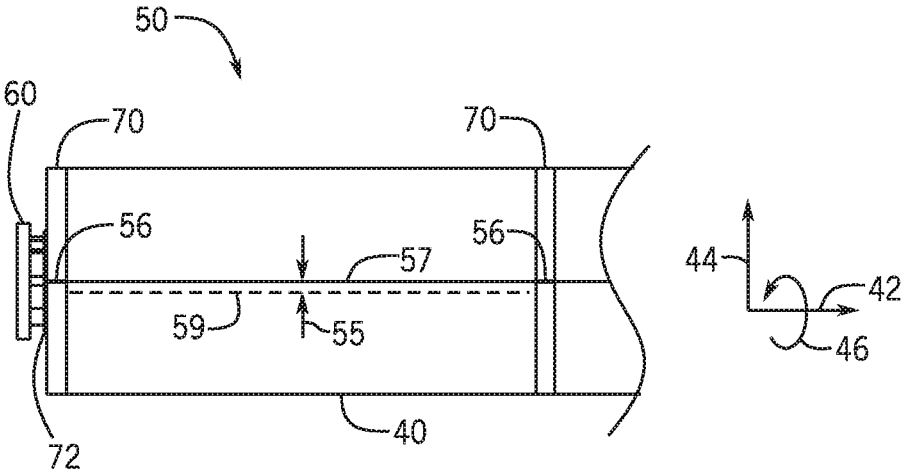
FIG. 4B illustrates a side view of the riser restraint device of FIG. 3.

FIG. 4A illustrates a cross section top view 48 of the elongated riser joint 40 and FIG. 4B illustrates a side view 50 of the elongated riser joint 40 when the riser joint 40 has an elliptical shape (e.g., with a length 52 and a width equivalent to 2× length 52, such that the length to width ratio is 2:1). As illustrated, the elongated riser joint 40 may include a buoyancy foam 54 that operates to provide buoyancy to the elongated riser joint 40 when submerged. The buoyancy foam 54 may be a single enclosure that operates as an outer (exterior) portion of the elongated riser joint 40 or the buoyancy foam 54 may be two or more distinct enclosures that may be affixed to one another via one or more fasteners 56 (e.g., screws, bolts, pins, locking mechanisms, or the like) or the two or more enclosures may be permanently affixed (e.g., welded) to one another to combine to form an outer (exterior) portion of the elongated riser joint 40. As illustrated in FIGS. 4A and 4B, in some embodiments, the elongated riser joint 40 may be offset by a distance 55 away from its center 57 along the illustrated so that its rotational axis 59 is not along the center 57, but rather, adjusted by distance 55 away from the center 57, for example, to enhance the response of the elongated riser joint 40 with respect to changes to the directions of currents 20 (e.g., to aid in providing a weathervane effect).

The buoyancy foam 54, in some embodiments, is rotatable around the main tube 58, through which, for example, drill pipes 19 may pass. As illustrated, the main tube 58 may be circular in shape and terminate in a flange 60 or a connector (e.g., a slick joint designed to prevent damage to the riser 12 and restrict lateral movement of one or more lines passing along the riser 12) with, for example, one or more apertures 62 through which choke and kill lines may pass, one or more apertures 64 through which a hydraulic line may pass, and one or more apertures 66 through which a booster line may pass. The flange 60 may allow for connection of the elongated riser joint 40 with another elongated riser joint 40 and/or a standard riser joint. The elongated riser joint 40 may also include fixed buoyancy foam 68 that, for example, directly surrounds the main tube 58 and one or more of the choke and kill lines, the hydraulic line, and the booster line. The material used for the buoyancy foam 54 and the fixed buoyancy foam 68 may be identical or, for example, the material used for the buoyancy foam 54 may be a non-absorbent (e.g., fluidly sealed) material while the material used for the fixed buoyancy foam 68 may not necessarily be a non-absorbent (e.g., fluidly sealed) material.

Furthermore, as illustrated in FIG. 4B, the buoyancy foam 54 may include one or more bands 70 disposed thereon and/or disposed between segments of buoyancy foam 54. In some embodiments, the bands 70 may be metallic strips or strips or similar materials that allow for connection points by the one or more fasteners 56 along the length of the elongated riser joint 40 in an axial direction 42. Additionally, a clamp 72 may be disposed beneath one or more of the bands 70. The clamp 72 may be made of metal or a similar minimally deformable material and may include a groove (e.g., a "U" groove) or other mounting guide which may be used to mount a rotating buoyancy assembly to allow for rotation of the buoyancy foam 54, for example, in a circumferential direction 46 about the main tube 58, such that the portion of the elongated riser joint 40 including an elongated body (e.g., buoyancy foam 54 or the buoyancy foam 54 and the one or more bands 70) is configured to rotate in a circumferential direction with respect to the flange 60. The components of the rotating buoyancy assembly may are illustrated in greater detail with respect to FIG. 5.

Figure 5:
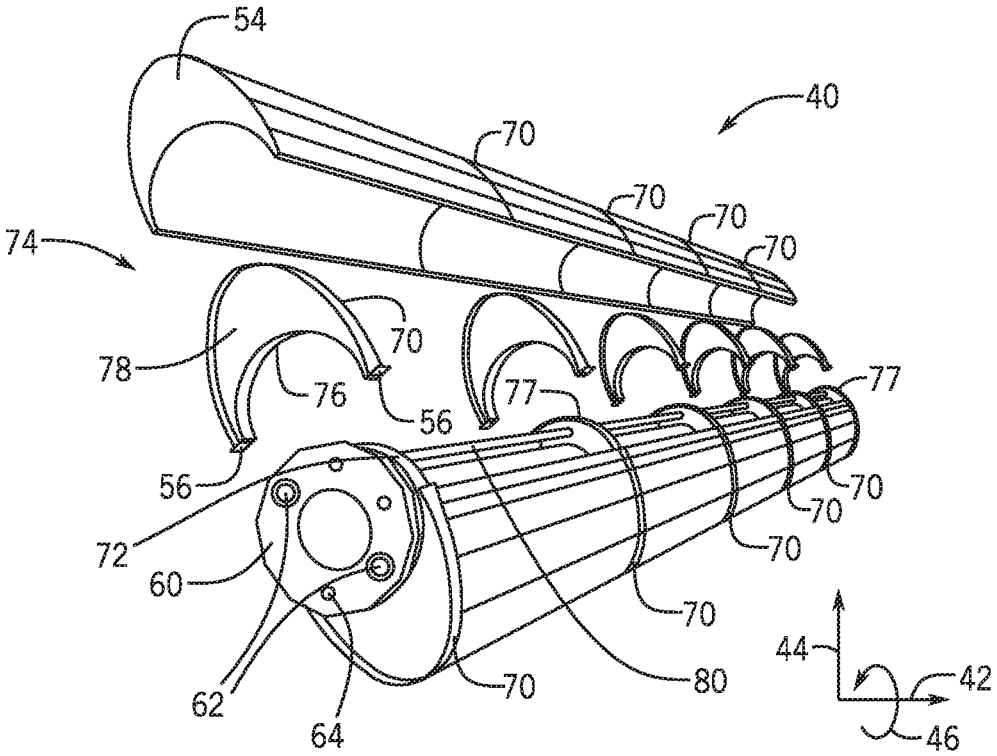
FIG. 5 illustrates an exploded view of the riser restraint device of FIG. 3.

FIG. 5 illustrates an exploded view of the elongated riser joint 40. As illustrated, a buoyancy assembly 74 may include a metal frame inclusive of the band 70 as well as the one or more fasteners 56. The buoyancy assembly 74 may provide the elongated shape to the elongated riser joint 40, as the buoyancy assembly 74 may be the external portion of the elongated riser joint 40 (e.g., via inclusion of the buoyancy foam 54 as a portion of the buoyancy assembly 74). Thus, the buoyancy assembly 74 may have an elliptical shape (which may, in some embodiments, include a rotational axis 59 offset from center 57 by distance 55), an airfoil shape (e.g., a fin, a blade, or a vane), a shape with a leading edge that tapers to a trailing edge (e.g., a teardrop), or the like so that the buoyancy assembly 74 (and, accordingly, the respective elongated riser joint 40), has an elongated non-circular shape as well as a non-cylindrical shape. As will be described in greater detail below, in some embodiments, the buoyancy assembly 74 may rotate in a circumferential direction 46 in response to external forces, for example, currents 20.

The buoyancy assembly 74 may also include a bearing 76 that may be formed between the one or more fasteners 56 and may interconnect with (e.g., be rotatably coupled to) the clamp 72 to allow for rotation of the buoyancy assembly 74 and, thus, the buoyancy foam 54, in a circumferential direction 46 about the main tube 58 (e.g., the buoyancy assembly 74 may thus be rotatably coupled to the main tube 58) to provide rotation of the buoyancy assembly 74 with respect to the flange 60. The bearing 76 may interface with (e.g., be coupled to while still allowing for rotation about) a support 77 that surrounds the main tube 58 and the support 77 may itself be statically coupled to the main tube 58. Thus, the bearing 76 (and, accordingly, the buoyancy assembly 74) is rotatably coupled to (e.g., coupled to while still allowing for rotation about) the support 77 and may allow for rotation in a circumferential direction 46 about the support 77 (and, thus, the main tube 58). As illustrated, the support 77 may include one or more apertures to allow for passage of a choke line, a kill line, a hydraulic line, a booster line, or the like through the support along the main tube 58.

In some embodiments, the bearing 76 may be a plain bearing such as a bushing or a journal (e.g., radial or rotary) bearing. Likewise, the bearing 76 may be a rolling-element bearing (e.g., a rolling bearing) that carries the load of the buoyancy assembly 74 and/or the buoyancy foam 54 via rolling elements (e.g., balls or rollers), while allowing for rotational motion (e.g., rotation of the buoyancy assembly 74 and, thus, the buoyancy foam 54 coupled thereto in a circumferential direction 46 about the main tube 58). As illustrated, the buoyancy assembly 74 may additionally include support 78 in the region between the band 70 and the bearing 76. The material used for the support 78 may be identical to or different from the material of one or more of the buoyancy foam 54 and the fixed buoyancy foam 68 or, in some embodiments, the support 78 may be metal, such as a steel or other metallic plate, that may be utilized to hold one or more the buoyancy foam 54 and the fixed buoyancy foam 68 in place. Additionally, it should be noted that FIG. 5 illustrates a region 80 about the main tube 58 and the auxiliary lines (e.g., one or more of the choke and kill lines, the hydraulic line, and the booster line) that may be filled by the fixed buoyancy foam 68 to form a circular rod with a circumference equal to or less than the radius of the clamp 72.

Figure 6:
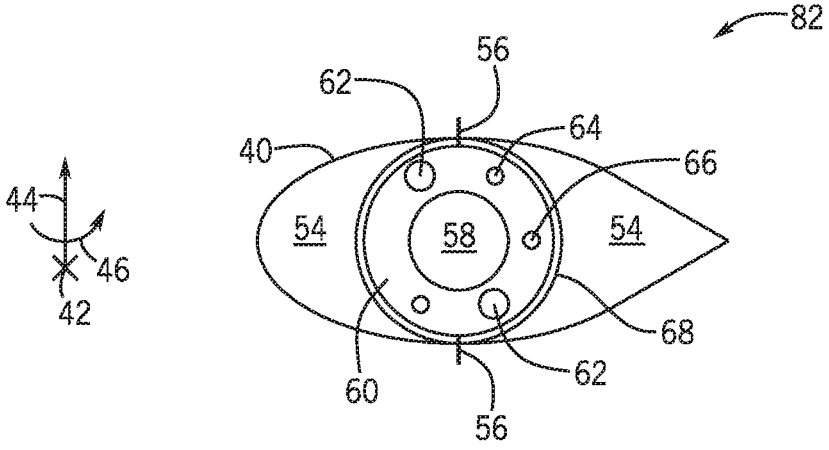
FIG. 6 illustrates a second top view of the riser restraint device of FIG. 3.

While FIG. 5 illustrates internal components of the elongated riser joint 40 with an elliptical shape (which may, in some embodiments, include a rotational axis 59 offset from center 57 by distance 55), as previously discussed, the elongated riser joint 40 may have alternative shapes while still utilizing analogous components to that described in FIG. 5. For example, FIG. 6 illustrates a cross section top view of an elongated riser joint 40 with an airfoil shape 82. As illustrated, the elongated riser joint 40 with an airfoil shape 82 includes buoyancy foam 54 that operates to provide buoyancy to the elongated riser joint 40 when submerged. The buoyancy foam 54 may be a single enclosure or the buoyancy foam 54 may be two or more enclosures that may be affixed to one another via one or more fasteners 56 (e.g., screws, bolts, pins, locking mechanisms, or the like) or the two or more enclosures may be permanently affixed (e.g., welded) to one another.

Additionally, the buoyancy foam 54 may rotate through rotation of the enclosures in a circumferential direction 46 in response to external forces, for example, currents 20 around the main tube 58, whereby the main tube 58 is circular in shape and terminates in a flange 60 with apertures 62, 64, and 66. The elongated riser joint 40 with an airfoil shape 82 may also include fixed buoyancy foam 68 that, for example, directly surrounds the main tube 58 and one or more of the choke and kill lines, the hydraulic line, and the booster line. Furthermore, the elongated riser joint 40 with an airfoil shape 82 may include the clamp 72 and the buoyancy assembly 74 discussed above with respect to FIG. 5, whereby the clamp 72 and the buoyancy assembly 74 operate in conjunction with one another to allow for rotation of the buoyancy foam 54, for example, in a circumferential direction 46 about the main tube 58 in response to currents 20.

As previously discussed, elongated riser joints 40 (whether shaped as illustrated in FIG. 5, FIG. 6, including a shape with a leading edge that tapers to a trailing edge, or the like) may be disposed along an entire length of the riser 12. Alternatively, the elongated riser joints 40 may be disposed along one or more predetermined portions of the riser 12 that cumulatively result in a length of elongated riser joints 40 less than an entire length of the riser 12. For example, determination of the location of the elongated riser joints 40 along the riser 12 may be determined based on the specific application in which the offshore vessel 10 is to be deployed. In some embodiments, charts may be developed based on measurements of the currents 20 at a particular drill site. Table 1 illustrates an example of such a chart:

TABLE 1

| Depth (ft) | 1 yr | 10 yr |
|---|---|---|
| 0 | 5.3 | 5.9 |
| 164 | 4.3 | 4.7 |
| 328 | 3.8 | 4.2 |
| 459 | 3.3 | 3.6 |
| 755 | 2.0 | 2.2 |
| 1115 | 1.6 | 2.1 |
| 1362 | 1.6 | 2.0 |
| 1788 | 1.2 | 1.3 |

TABLE 1-continued

| Depth (ft) | 1 yr | 10 yr |
|---|---|---|
| 2100 | 1.2 | 1.6 |
| 2461 | 1.5 | 2.3 |
| 3002 | 2.0 | 2.2 |
| 3412 | 2.0 | 2.9 |
| 4577 | 0.0 | 0.0 |

Table 1 describes the speed of currents 20 at particular depths over periods of time, for example, one year and ten years. Using this information, a determination of the location (e.g., depth) of an elongated riser joint 40, two or more consecutively disposed elongated riser joints 40 (e.g., two or more elongated riser joints 40 directly coupled to one another), and/or two or more non-consecutively disposed elongated riser joints 40 (e.g., two or more elongated riser joints 40 disposed along the riser 12 but not directly coupled with one another) can be made. Once this determination is made, disposing the elongated riser joint(s) 40 may occur. However, it may be appreciated that other information separate from or in addition to the information of Table 1 may be used in determining location(s) and/or numbers of elongated riser joints 40 disposed along the riser 12.

In some embodiments, the buoyancy foam 54 may be coupled to the main tube 58 prior the elongated riser joint 40 being lowered into the sea (e.g., on the drillship 10 while the riser string 12 is being made up). Alternatively, the buoyancy foam 54 may be coupled to the main tube 58 once disposed in the sea (e.g., once the elongated riser joint 40 is deployed). For example, a Remotely Operated Vehicles (ROV) may be utilized to affix the buoyancy foam 54 to the riser 12 or pup joint in step 66. An ROV may be a remotely controllable robot/submersible vessel with that may be controlled from the drillship 10. The ROV may move to a selected point in the riser string (e.g., to the deployed elongated riser joint 40) and couple buoyancy foam 54 may be coupled to the main tube 58 at the predetermined position (depth) determined for the elongated riser joint 40.

This written description uses examples to disclose the above description, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A device, comprising:

a main tube disposed along a length of the device;

a support member configured to be coupled to the main tube at a first location along the main tube, wherein the support member is configured to surround the main tube;

a buoyancy assembly configured to at least partially surround the main tube and at least partially surround the support member, wherein the buoyancy assembly comprises an elongated non-circular and non-cylindrical shape, wherein the buoyancy assembly comprises buoyancy foam; and fixed buoyancy foam that is separate from the buoyancy foam and configured to contact and surround the main tube at a second location along the main tube, wherein the buoyancy foam is configured to at least partially surround the fixed buoyancy foam.

2. The device of claim 1, comprising a flange coupled to the main tube, wherein the flange is configured to couple the device to a riser joint or an elongated riser joint.

3. The device of claim 2, wherein the flange comprises an aperture configured to pass a choke line, a kill line, a hydraulic line, or a booster line through the flange and along the main tube.

4. The device of claim 1, wherein the support member comprises an aperture configured to pass a choke line, a kill line, a hydraulic line, or a booster line through the support member along the main tube.

5. The device of claim 4, wherein the fixed buoyancy foam is configured to surround at least one of the choke line, the kill line, the hydraulic line, or the booster line.

6. The device of claim 1, wherein the buoyancy assembly is configured to rotate about the main tube in a circumferential direction.

7. The device of claim 1, wherein the buoyancy assembly comprises a bearing configured to be rotatably coupled to the support member to allow for rotation of the buoyancy assembly about the main tube, wherein the buoyancy assembly comprises a band configured to be coupled to the buoyancy foam.

8. The device of claim 7, wherein the bearing is configured to be coupled to the band, wherein the bearing and the band define a region configured to house second buoyant foam that is separate from the buoyancy foam and the fixed buoyancy foam.

9. The device of claim 7, wherein the buoyancy assembly comprises additional second buoyancy foam coupled to a second band.

10. The device of claim 9, wherein the buoyancy assembly comprises a fastener configured to couple the first band to the second band.

11. A device, comprising:

a flange disposed at a terminal end of a main tube disposed along a length of the device, wherein the flange is configured to couple the device to a riser joint or an elongated riser joint; and an elongated body configured to be coupled to the main tube, wherein the elongated body comprises an elongated non-circular and non-cylindrical shape in a radial direction of the device, wherein the elongated body comprises buoyancy foam which forms an outer exterior portion of the elongated body, wherein the buoyancy foam is configured to rotate in a circumferential direction with respect to the flange.

12. The device of claim 11, wherein the elongated body comprises an elliptical shape as the elongated non-circular and non-cylindrical shape.

13. The device of claim 11, wherein the elongated body comprises an airfoil shape as the elongated non-circular and non-cylindrical shape.

14. The device of claim 11, wherein the elongated body comprises a leading edge that tapers to a trailing edge as the elongated non-circular and non-cylindrical shape.

15. The device of claim 11, wherein the elongated body comprises one or more streamline bodies as the elongated non-circular and non-cylindrical shape.

16. The device of claim 11, wherein the elongated body is configured to rotate in the circumferential direction with respect to the flange about a rotational axis offset from a center of the elongated body.

17. The device of claim 11, wherein the device comprises an elongated riser joint configured to reduce vortex induced vibrations and provide a reduced drag coefficient with respect to a circular or cylindrical shaped riser joint.

18. A method, comprising:

disposing an elongated non-circular and non-cylindrical shaped buoyancy assembly at least partially about a main tube to form an elongated riser joint, wherein the buoyancy assembly comprises buoyancy foam which forms an outer exterior portion of the buoyancy assembly, wherein the buoyancy assembly is configured to rotate in a circumferential direction with respect to the main tube.

19. The method of claim 18, wherein disposing the elongated non-circular and non-cylindrical shaped buoyancy assembly at least partially about the main tube comprises disposing a first portion of the buoyancy assembly about the main tube, disposing a second portion of the buoyancy assembly about the main tube, and fastening the first portion of the buoyancy assembly and the second portion of the buoyancy assembly to form the elongated non-circular and non-cylindrical shaped buoyancy assembly.

* * * * *